US007188760B1

(12) United States Patent
Preston

(10) Patent No.: US 7,188,760 B1
(45) Date of Patent: Mar. 13, 2007

(54) COUNTING APPARATUS

(76) Inventor: Robert W. Preston, 11220 Moorpark St., #108, Studio City, CA (US) 91604

( * ) Notice: Subject to any disclaimer, the term of this patent is extended or adjusted under 35 U.S.C. 154(b) by 0 days.

(21) Appl. No.: 11/030,709

(22) Filed: Jan. 7, 2005

(51) Int. Cl.
*G06C 29/00* (2006.01)

(52) U.S. Cl. ..... 235/60 C; 235/423; 235/59

(58) Field of Classification Search ..... 235/60 C, 235/50 R, 58, 59
See application file for complete search history.

(56) References Cited

U.S. PATENT DOCUMENTS

| | | | | |
|---|---|---|---|---|
| 3,641,321 | A * | 2/1972 | Tonne | 377/20 |
| 4,114,807 | A * | 9/1978 | Naseck et al. | 236/1 E |
| 4,280,207 | A * | 7/1981 | Maezawa | 368/21 |
| 5,084,695 | A * | 1/1992 | Freeman | 340/323 R |
| D419,460 | S * | 1/2000 | Mann | D10/46.1 |
| 6,513,707 | B1 * | 2/2003 | Haglof | 235/59 R |
| 6,919,804 | B1 * | 7/2005 | Cook et al. | 340/541 |
| 2004/0204057 | A1 * | 10/2004 | Ku | 455/556.1 |
| 2004/0239503 | A1 * | 12/2004 | Rider et al. | 340/572.1 |

FOREIGN PATENT DOCUMENTS

JP 2006039771 A * 2/2006

* cited by examiner

*Primary Examiner*—Thien M. Le
*Assistant Examiner*—Edwyn Labaze
(74) *Attorney, Agent, or Firm*—Mind Law Firm; Jeromye V. Sartain

(57) ABSTRACT

A counting apparatus for counting the number of persons in an establishment. The counting apparatus includes a housing being designed for being held in a hand of a user. An intake assembly is coupled to the housing. The intake assembly is designed for being actuated by the user when a person enters an establishment. A processing assembly is positioned in the housing. The processing assembly is operationally coupled to the intake assembly whereby the processing assembly processes each time the intake assembly is actuated by the user. A count display member is coupled to the housing. The count display member is operationally coupled to the processing assembly whereby the count display member is designed for displaying the number of times the intake assembly is actuated.

11 Claims, 2 Drawing Sheets

COUNTING APPARATUS

BACKGROUND OF THE INVENTION

1. Field of the Invention

The present invention relates to handheld counting devices and more particularly pertains to a new counting apparatus for counting the number of persons in an establishment.

2. Description of the Prior Art

The use of handheld counting devices is known in the prior art. U.S. Pat. No. 3,978,321 describes a device for counting the number of vehicle entering a parking lot. Another type of handheld counting device is U.S. Pat. No. 4,532,415 having a counter having a plurality of wheels having numbers wherein the wheels are rotated in increments to show the incrementing the numbers as counter is actuated by the user. U.S. Pat. No. Des 371,550 shows a hand held personal scanner. U.S. Pat. No. 3,967,096 has an electromagnetic counter having a digit wheel that is actuated by an armature of an electromagnet to instigate incremental counting. U.S. Pat. No. 3,886,375 has a system for counting components produced by machine tools. U.S. Pat. No. 3,721,806 has a supplemental readout for electronically sensing the incrementing of the numeral wheels and transmitting that information to a remote electronic device.

While these devices fulfill their respective, particular objectives and requirements, the need remains for an apparatus that has certain improved features that provides for removing numbers from the total to provide an accurate count of the people in the establishment.

SUMMARY OF THE INVENTION

The present invention meets the needs presented above by providing an outtake assembly that is actuated by the user when a person leaves the establishment and is subtracted from the total of persons who entered to provide an number people remaining in the establishment.

Still yet another object of the present invention is to provide a new counting apparatus that provides a count of the number of people who have entered the establishment.

Even still another object of the present invention is to provide a new counting apparatus that keeps a count of the number of people in an establishment to prevent the establishment from having too many people within the establishment.

To this end, the present invention generally comprises a housing being designed for being held in a hand of a user. An intake assembly is coupled to the housing. The intake assembly is designed for being actuated by the user when a person enters an establishment. A processing assembly is positioned in the housing. The processing assembly is operationally coupled to the intake assembly whereby the processing assembly processes each time the intake assembly is actuated by the user. A count display member is coupled to the housing. The count display member is operationally coupled to the processing assembly whereby the count display member is designed for displaying the number of times the intake assembly is actuated by the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
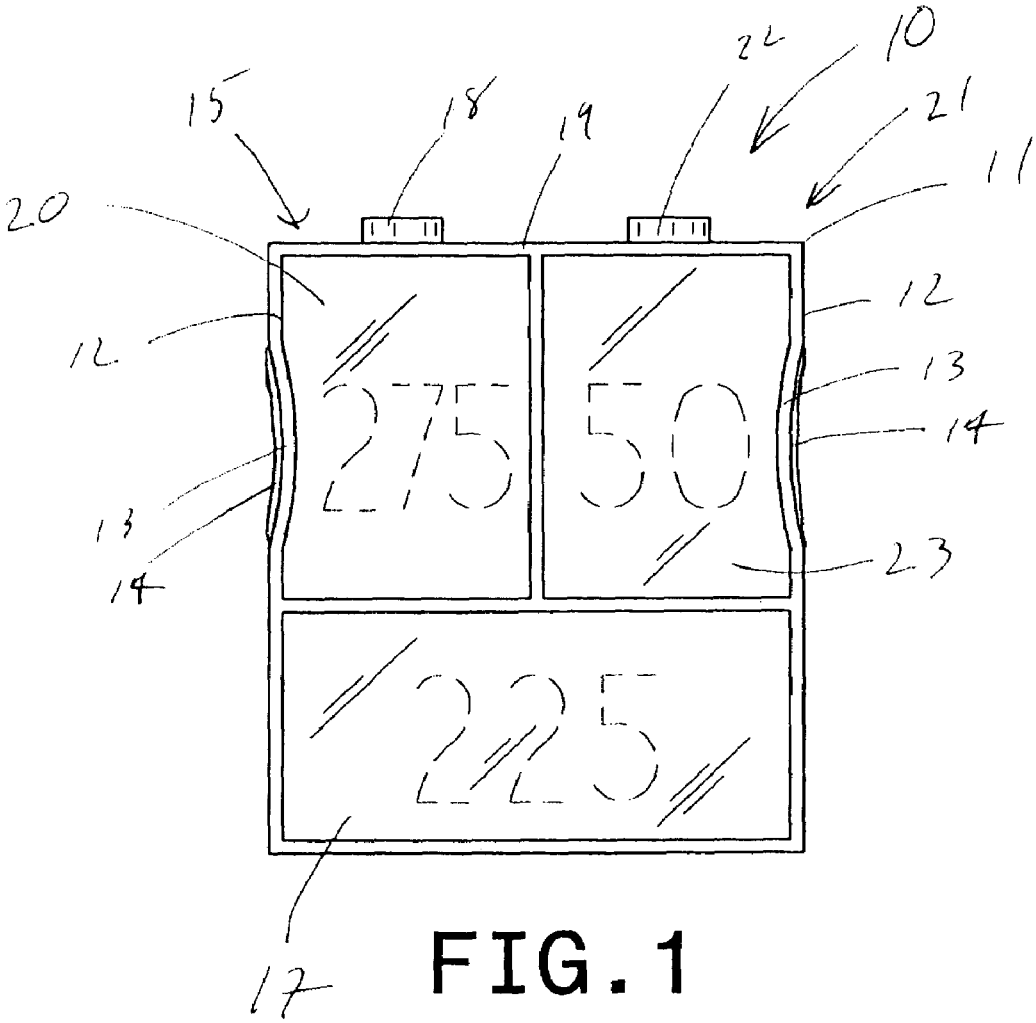
FIG. 1 is a front view of a new counting apparatus according to the present invention.
Figure 2:
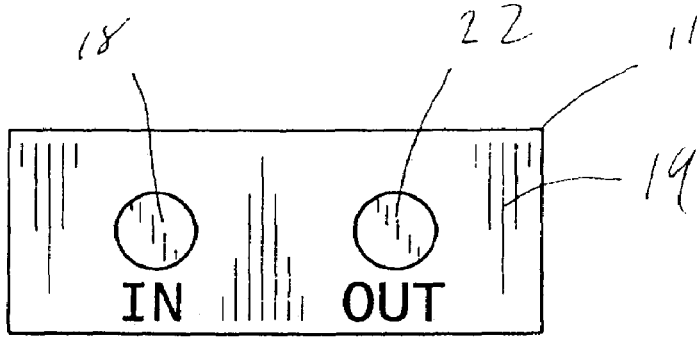
FIG. 2 is a top view of the present invention.
Figure 3:
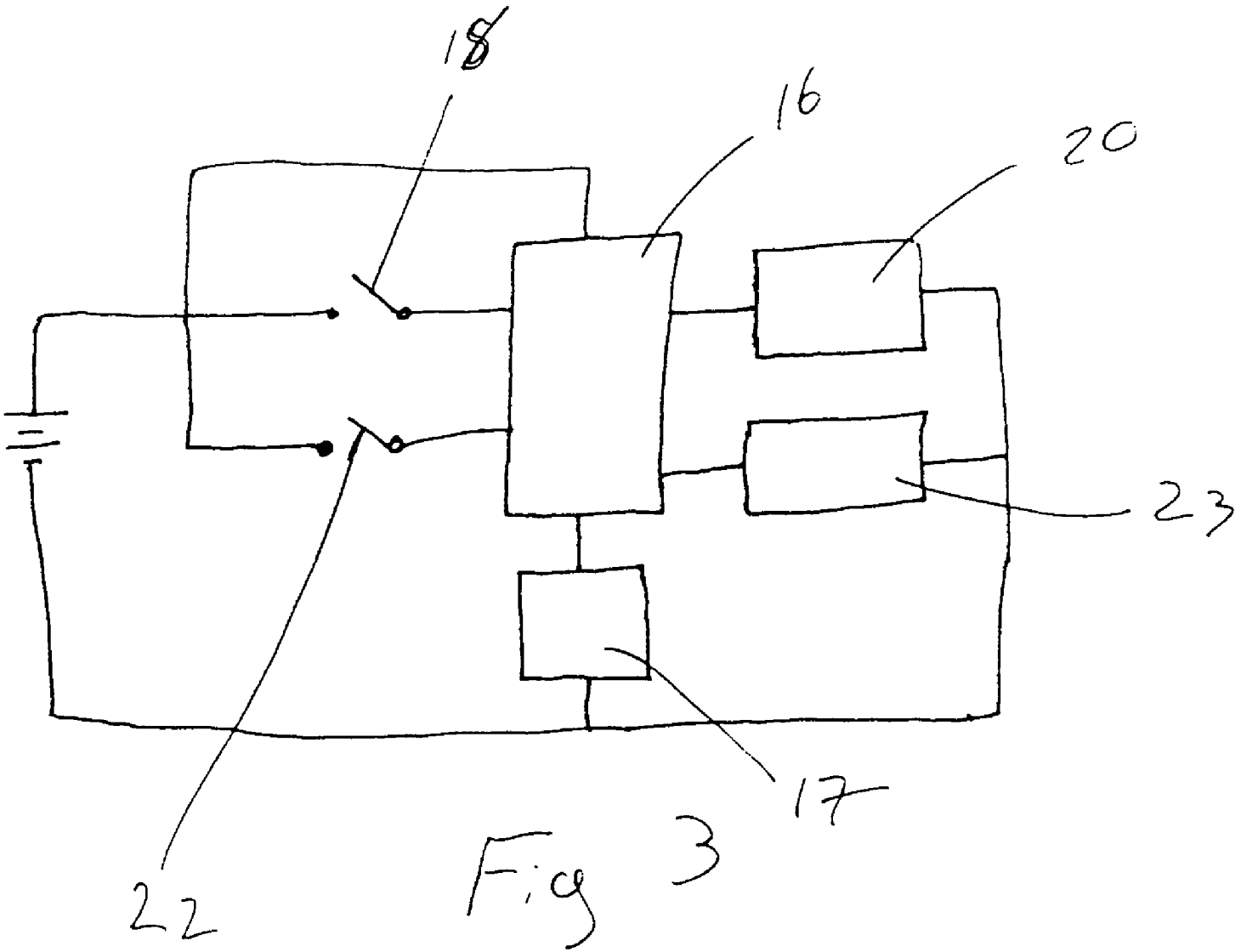
FIG. 3 is a schematic view of the present invention.

With reference now to the drawings, and in particular to FIGS. 1 through 3 thereof, a new counting apparatus embodying the principles and concepts of the present invention and generally designated by the reference numeral 10 will be described.

As best illustrated in FIGS. 1 through 3, the counting apparatus 10 generally comprises a housing 11 being designed for being held in a hand of a user. The housing 11 comprises a pair of side walls 12. Each of the side walls 12 has a concave portion 13 whereby the concave portion 13 of each of the side walls 12 is designed for receiving a portion of the hand of the user for inhibiting sliding of the housing 11 from the hand of the user. Each of a pair of gripping members 14 is positioned in the concave portion 13 of each of the side walls 12. Each of the gripping members 14 comprises a friction enhancing material whereby the friction enhancing material is designed for increasing the friction between the housing 11 and the hand of the user for inhibiting sliding of the housing 11 from the hand of the user. The housing 11 has a length of about 3 inches, a width of 2 and ½ inches and depth of less than an inch.

An intake assembly 15 is coupled to the housing 11. The intake assembly 15 is designed for being actuated by the user when a person enters an establishment.

A processing assembly 16 is positioned in the housing 11. The processing assembly 16 is operationally coupled to the intake assembly 15 whereby the processing assembly 16 processes each time the intake assembly 15 is actuated by the user.

A count display member 17 is coupled to the housing 11. The count display member 17 is operationally coupled to the processing assembly 16 whereby the count display member 17 is designed to display the number of times the intake assembly 15 is actuated by the user.

The intake assembly 15 comprises an intake switch member 18. The intake switch member 18 is coupled to the housing 11. The intake switch member 18 is operationally coupled to the processing assembly 16. The intake switch member 18 is designed for being actuated by the user for permitting the processing assembly 16 to process entrance of a patron into an establishment. The intake switch member 18 is coupled to an upper wall 19 of the housing 11 whereby the intake switch member 18 is designed for being actuated by a phalange of the hand of the user when the housing 11 is being held by the user.

The intake assembly 15 comprises an intake display member 20. The intake display member 20 is coupled to the housing 11. The intake display member 20 is operationally coupled to the processing assembly 16 whereby the intake display member 20 displays the number of times the intake switch member 18 is actuated.

An outtake assembly 21 is coupled to the housing 11. The outtake assembly 21 is operationally coupled to the processing assembly 16. The outtake assembly 21 is designed for being actuated by the user when a person leaves an establishment. The processing assembly 16 processes each time the outtake assembly 21 is actuated whereby the processing assembly 16 deducts the actuation of the outtake assembly 21 from the number of times the intake assembly 15 has been actuated. The count display member 17 displays the number of times the intake assembly 15 minus the number times the outtake assembly 21 has been actuated.

The outtake assembly 21 comprises an outtake switch member 22. The outtake switch member 22 is coupled to the housing 11. The outtake switch member 22 is operationally coupled to the processing assembly 16. The outtake switch member 22 is designed for being actuated by the user for permitting the processing assembly 16 to process exiting of a patron from an establishment. The outtake switch member 22 is coupled to the upper wall 19 of the housing 11 whereby the outtake switch member 22 is designed for being actuated by a phalange of the hand of the user when the housing 11 is being held by the user.

The outtake assembly 21 comprises an outtake display member 23. The outtake display member 23 is coupled to the housing 11. The outtake display member 23 is operationally coupled to the processing assembly 16 whereby the outtake display member 23 displays the number of times the outtake switch member 22 is actuated.

In use, the user holds the housing 11 in their hand. As people enter the establishment the user actuates the intake switch member 18 which then increments the number of people entering the establishment shown on the intake display member 20. The outtake switch member 22 is then actuated by the user as a person leaves an establishment which then increments the number being displayed on the outtake display member 23. The processing assembly 16 calculates the number of times the intake switch member 18 has been actuated and subtracts the number of times the outtake switch member 22 has been actuated and displays that total on the count display member 17 to represent the number of people in the establishment.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A counting apparatus for tracking the number of people in an establishment, the counting apparatus comprising:

a housing being adapted for being held in a hand of a user;

an intake assembly being coupled to the housing, the intake assembly being adapted for being actuated by the user when a person enters the establishment;

a processing assembly being positioned in the housing, the processing assembly being operationally coupled to the intake assembly such that the processing assembly processes each time the intake assembly is actuated by the user; and a count display member being coupled to the housing, the count display member being operationally coupled to the processing assembly such that the count display member is adapted for displaying the number of times the intake assembly is actuated by the user.

2. The counting apparatus as set forth in claim 1, further comprising:

the intake assembly comprising an intake switch member, the intake switch member being coupled to the housing, the intake switch member being operationally coupled to the processing assembly, the intake switch member being adapted for being actuated by the user for permitting the processing assembly to process entrance of a person into the establishment.

3. The counting apparatus as set forth in claim 2, wherein the intake switch member is coupled to an upper wall of the housing such that the intake switch member is adapted for being actuated by a phalange of the hand of the user when the housing is being held by the user.

4. The counting apparatus as set forth in claim 2, further comprising:

the intake assembly comprising an intake display member, the intake display member being coupled to the housing, the intake display member being operationally coupled to the processing assembly such that the intake display member displays the number of times the intake switch member is actuated.

5. The counting apparatus as set forth in claim 1, further comprising:

an outtake assembly being coupled to the housing, the outtake assembly being operationally coupled to the processing assembly, the outtake assembly being adapted for being actuated by the user when a person leaves the establishment, the processing assembly processing each time the outtake assembly is actuated such that the processing assembly deducts the actuation of the outtake assembly from the number of times the intake assembly has been actuated, the count display member displaying the difference between the number of times the intake assembly has been actuated and the number of times the outtake assembly has been actuated.

6. The counting apparatus as set forth in claim 5, further comprising:

the outtake assembly comprising an outtake switch member, the outtake switch member being coupled to the housing, the outtake switch member being operationally coupled to the processing assembly, the outtake switch member being adapted for being actuated by the user for permitting the processing assembly to process exiting of a person from the establishment.

7. The counting apparatus as set forth in claim 6, further comprising:

the outtake assembly comprising an outtake display member, the outtake display member being coupled to the housing, the outtake display member being operationally coupled to the processing assembly such that the outtake display member displays the number of times the outtake switch member is actuated.

8. The counting apparatus as set forth in claim 6, wherein the outtake switch member is coupled to an upper wall of the housing such that the outtake switch member is adapted for being actuated by a phalange of the hand of the user when the housing is being held by the user.

9. A counting apparatus for tracking the number of people in an establishment, the counting apparatus comprising:

a housing being adapted for being held in a hand of a user;

an intake assembly being coupled to the housing, the intake assembly being adapted for being actuated by the user when a person enters the establishment;

a processing assembly being positioned in the housing, the processing assembly being operationally coupled to the intake assembly such that the processing assembly processes each time the intake assembly is actuated by the user;

a count display member being coupled to the housing, the count display member being operationally coupled to the processing assembly such that the count display member is adapted for displaying the number of times the intake assembly is actuated by the user; and an outtake assembly being coupled to the housing, the outtake assembly being operationally coupled to the processing assembly, the outtake assembly being adapted for being actuated by the user when a person leaves the establishment, the processing assembly processing each time the outtake assembly is actuated such that the processing assembly deducts the actuation of the outtake assembly from the number of times the intake assembly has been actuated, the count display member displaying the difference between the number of times the intake assembly has been actuated and the number of times the outtake assembly has been actuated.

10. A counting apparatus for tracking the number of people in an establishment, the counting apparatus comprising:

a means for a user to hold the counting apparatus;

a first means coupled to the counting apparatus for being actuated by the user when a person enters the establishment;

a second means coupled to the counting apparatus for being actuated by the user when a person leaves the establishment; and a means for displaying the number of people in the establishment as the difference between the number of times the user has actuated the first actuation means and the number of times the user has actuated the second actuation means.

11. A method for tracking the number of people in an establishment, comprising the steps of holding a counting apparatus having a housing; actuating an intake assembly coupled to the housing when a person enters the establishment; and actuating an outtake assembly coupled to the housing when a person exits the establishment, and comprising the further steps of dynamically calculating a total number of people in the establishment at any moment by subtracting the number of times the outtake assembly has been actuated from the number of times the intake assembly has been actuated; and displaying the total number of people.

* * * * *